US005120193A

United States Patent [19]

Kadle et al.

[11] Patent Number: 5,120,193

[45] Date of Patent: Jun. 9, 1992

[54] BAFFLE FOR REDUCING AIRFLOW NOISE IN A SCROLL HOUSING

[75] Inventors: Durgaprasad S. Kadle, Getzville, N.Y.; Andrew R. Morris, Warwickshire, England; James H. Fu, Getzville, N.Y.

[73] Assignee: General Motors Corporation, Detroit, Mich.

[21] Appl. No.: 718,461

[22] Filed: Jun. 20, 1991

Related U.S. Application Data

[63] Continuation of Ser. No. 485,302, Feb. 26, 1990, abandoned.

[51] Int. Cl.[5] ..... F01D 5/00; F01D 25/00

[52] U.S. Cl. ..... 415/119; 415/206; 415/208.3

[58] Field of Search ..... 415/119, 188, 191, 205, 415/206, 207, 211.1, 211.2, 212.1, 224, 208.3, 915

[56] References Cited

U.S. PATENT DOCUMENTS

| | | | |
|---|---|---|---|
| 4,078,870 | 3/1978 | Keller et al. | 415/54 |
| 4,470,753 | 9/1984 | Witzel | 415/119 |
| 4,494,908 | 1/1985 | Hopfensperger | 415/206 |
| 4,680,006 | 7/1987 | Fisher | 415/119 |
| 4,705,453 | 11/1987 | Hopfensperger | 415/119 |
| 4,712,976 | 12/1987 | Hopfensperger et al. | 415/54 |
| 4,799,287 | 1/1989 | Belanger et al. | 415/206 |

FOREIGN PATENT DOCUMENTS

| | | | |
|---|---|---|---|
| 0117918 | 9/1979 | Japan | 415/119 |
| 0051198 | 3/1984 | Japan | 415/119 |
| 0591620 | 3/1978 | U.S.S.R. | 415/119 |

*Primary Examiner*—Edward K. Look
*Assistant Examiner*—Hoang Nguyen
*Attorney, Agent, or Firm*—A. Michael Tucker

[57] ABSTRACT

A scroll housing includes a spiral portion and an outlet portion. A blower fan is mounted on the spiral portion and rotated to draw an axial air current into the scroll housing. The airflow is channeled away from the scroll housing by the outlet portion which is tangentially aligned with the blower fan. A baffle is mounted on an interior surface of the spiral portion upstream from a cutoff provided adjacent the intersection of the spiral portion and the outlet portion. The baffle projects into the exiting airflow from the blower fan and reduces airflow noise.

6 Claims, 2 Drawing Sheets

BAFFLE FOR REDUCING AIRFLOW NOISE IN A SCROLL HOUSING

This is a continuation of U.S. patent application Ser. No. 07/485302 filed on Feb. 26, 1990, now abandoned.

BACKGROUND OF THE INVENTION

1. Field of the Invention

Blower assemblies for vehicles are airflow in a scroll housing, and in particular is concerned with a baffle mounted on an interior surface of a scroll housing for reducing airflow noise.

2. Description of the Related Art

Blower assemblies for vehicles are well-known. In general, an assembly includes a blower motor and fan mounted on a scroll housing. The scroll housing is mounted to a surface of the dash panel adjacent the engine compartment of the vehicle. Air is drawn along the axis of the fan into the scroll housing and exits tangentially from the fan blades.

Fans used in automotive applications usually have economical, forward-swept blades. In most vehicular heating/air conditioning systems, a fan will operate at certain times in the surge or stall regions. Such operation can result in dramatic increases in noise caused by unstable and unsteady airflows in these regions. The noise can be described as a low frequency, oscillatory rumble. This rumble is caused by vortex shedding and the resulting instability of airflow exiting a blade and subsequent reattachment to the next blade as the fan rotates, and is known as Helmholtz type of resonance. Such noise has also been observed in axial flow compressors.

The art continues to seek improvements. It is desirable to utilize a blower assembly and scroll housing for use with a heating/air conditioning system of a vehicle. Furthermore, it is desirable that the low frequency, oscillatory rumbles which occur in conventional systems be reduced or eliminated.

SUMMARY OF THE INVENTION

The present invention is directed to a scroll housing for a blower assembly of a vehicular heating/air conditioning system. The scroll housing includes a baffle mounted on its interior surface. The baffle reduces noise caused by airflow instability as air is drawn axially into the scroll housing and exited tangentially. The present baffle reduces the low frequency, oscillatory rumble which can occur in conventional scroll housings. The present baffle is economical to manufacture and can be utilized with conventional blower fans and scroll housings.

In a preferred embodiment of the present invention, a scroll housing includes a spiral portion and an outlet portion. A blower fan is mounted on the spiral portion and rotated to draw an axial air current into the scroll housing. The airflow is channeled away from the scroll housing by the outlet portion which is tangentially aligned with the blower fan. A baffle is mounted on an interior surface of the spiral portion upstream from a cutoff provided adjacent the intersection of the spiral portion and the outlet portion. The baffle projects into the exiting airflow from the blower fan and reduces airflow noise.

DETAILED DESCRIPTION OF THE PREFERRED EMBODIMENT

Figure 1:
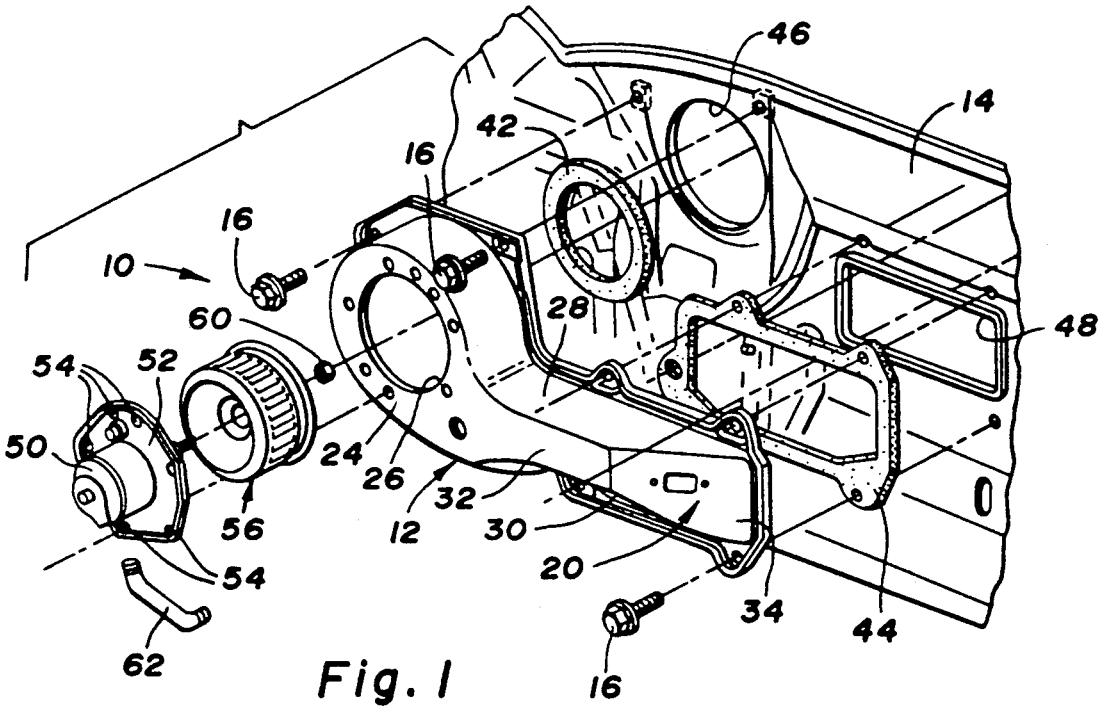
FIG. 1 is an exploded, perspective view of a blower assembly including a motor, fan and the scroll housing mounted on a dash panel of a vehicle.
Figure 2:
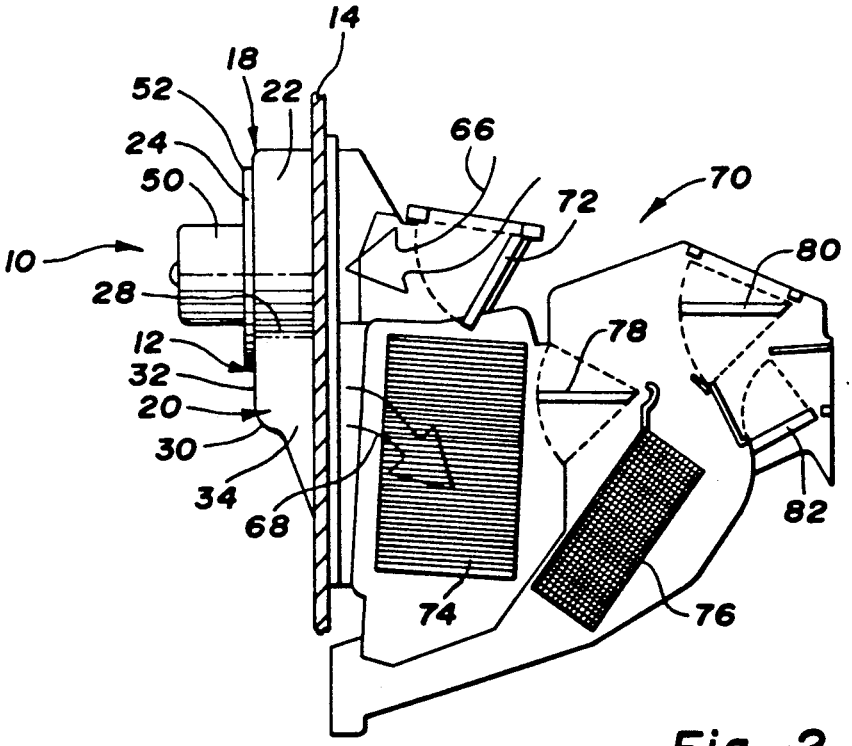
FIG. 2 is an assembled, top view of the blower assembly of FIG. 1 mounted on the dash panel illustrating inlet and outlet airflows to and from the blower assembly in cooperation with a conventional heating/air conditioning system.

A blower assembly indicated generally at 10 is illustrated in FIGS. 1 and 2. The assembly 10 includes a scroll housing 12 mounted on a vehicle dash panel 14 by a plurality of fasteners 16. The scroll housing 12 includes a spiral or coiled portion 18 and an outlet portion 20.

The spiral portion 18 is bounded by a well-known curved wall 22 having a continuously expanding diameter and an annular outer face 24 with a central opening 26 therein. The outlet portion 20 is aligned with and joins the curved wall 22. In the embodiment of the FIGURES, the outlet portion 20 is formed by an upper side wall 28, a lower side wall 30, an outer face 32 and a sloping face 34. Preferably, the spiral portion 18 and the outlet portion 20 are formed as an integral construction from a moldable plastic material. It is appreciated that other configurations and forms of the spiral portion 18 and the outlet portion 20 are within the scope of this invention.

Adjacent the intersection of the spiral portion 18 (FIG. 3) and the outlet portion 20, (i.e., the intersection of a starting portion of the curved wall 22 and the upper side wall 28) a well-known cutoff 36 is provided on an interior surface 38 of the spiral portion 18. Preferably, the cutoff 36 is constructed and arranged with the curved wall 22 to provide the closest approach to the center point of the spiral portion 18. The cutoff 36 is formed as a rounded or curved surface and preferably spans the width of the curved wall. The cutoff 36 can be integrally mounted with the scroll housing 12 or can be formed separately and attached as desired.

To improve the seal between the dash panel 14 and the scroll housing 12, respective mounting gaskets 42 and 44 are provided at an air inlet 46 and an air outlet 48 of the dash panel 14. Airflow is directed through the scroll housing 12 as described below.

A blower motor 50 and an attached mounting plate 52 are mounted on the outer face 24 of the spiral portion 18 by fasteners 54 so that the blower motor 50 projects through the opening 26 and the mounting plate 52 covers the opening 26. A well-known blower fan or impeller 56 having a plurality of blades 58 is secured to the blower motor 50 by a fastener 60 and projects into the annular volume bounded by the spiral portion 18. Preferably, the blower fan 56 is a centrifugal fan. The outlet portion 20 is substantially tangentially aligned with the outer diameter of the blower fan 56 to receive exit airflow from the blower fan 56 as described below. A cooling tube 62 directs cooling air to the blower motor 50 from the outlet portion 20.

In operation, the blower motor 50 drives the blower fan 56 in a counterclockwise direction indicated at directional arrow 64. As illustrated in FIG. 2, an inlet air current indicated at 66 is drawn into the spiral portion 18 through the air inlet 46. Inlet air current 66 provides well-known axial airflow drawn along the axis of the blower fan 56 into the annular volume of the spiral portion 18. The blades 58 direct the inlet axial airflow to a tangential airflow channeled to the air outlet 48 by the outlet portion 18 of the scroll housing 12. Outlet air current indicated at 68 exits the air outlet 48 and is directed to a conventional heating/air conditioning system 70 for creating the desired air temperature and flow direction in a well-known manner. The system 70 schematically illustrated in FIG. 2. is representative of a conventional system and can include an inlet valve 72, an evaporator core 74, a heater core 76, a temperature valve 78, a mode valve 80, and a defrost valve 82, all of which are known in the art.

Figure 3:
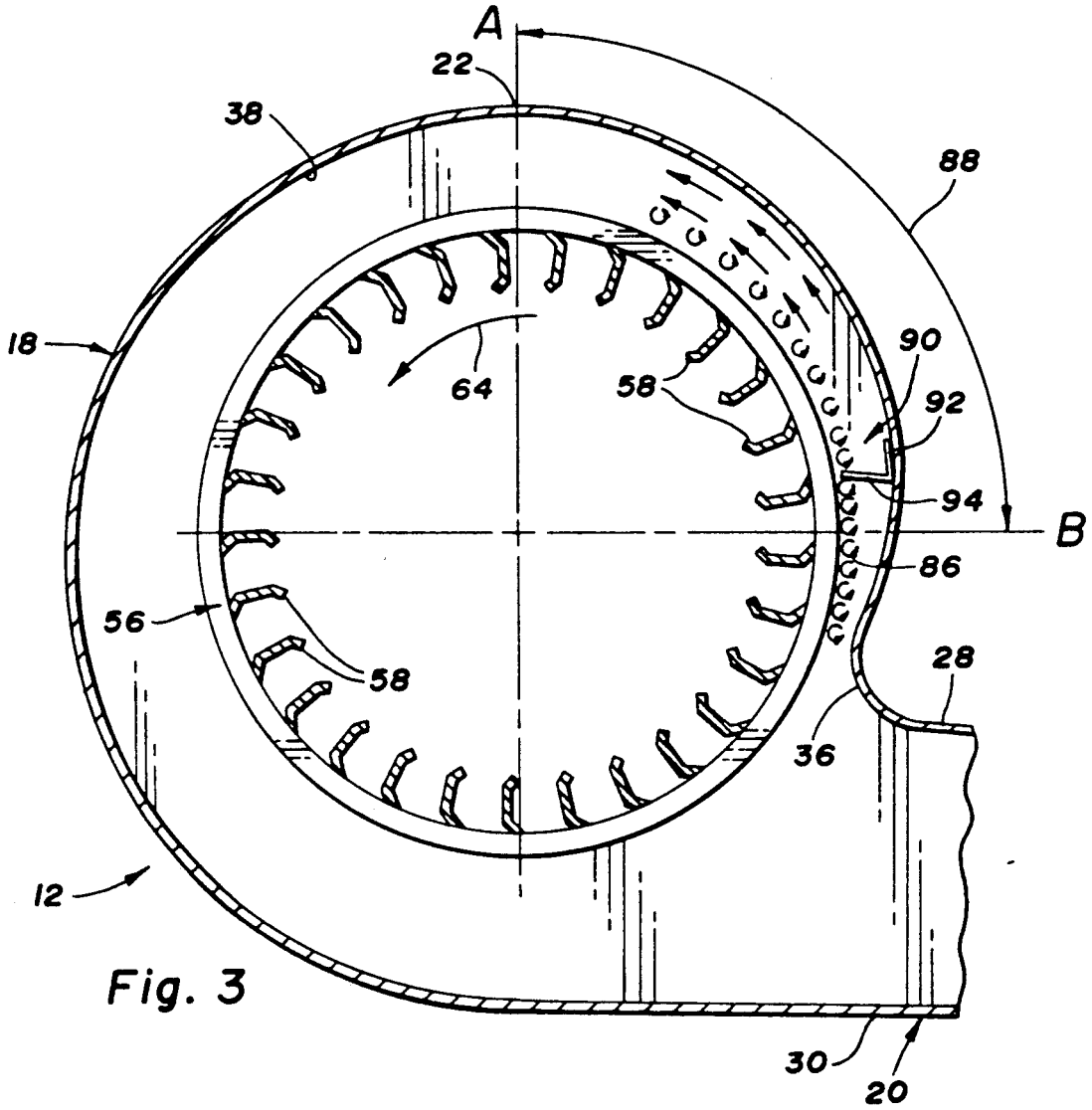
FIG. 3 is an enlarged, partial sectional view of a spiral portion of scroll housing illustrating a baffle mounted on an interior surface and the airflow inside the spiral portion.

As illustrated in FIG. 3, centrifugal forces and the blades 58 of the blower fan 56 direct the air inside the spiral portion 18 in a counterclockwise direction. As the air exits the blades 58, vortex shedding can result in airflow instability as indicated by directional arrows 86. Such instability 86 can result in a low frequency rumbling noise when the blower assembly 10 is operated at certain modes and speeds to obtain a selected airflow from the system 70.

Figure 4:
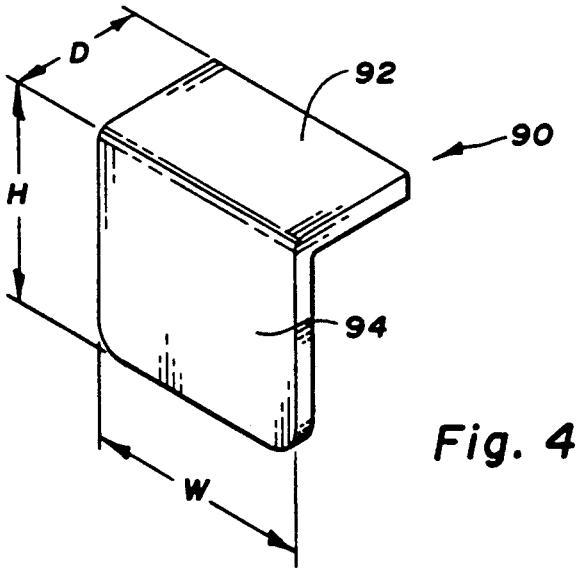
FIG. 4 is an enlarged, perspective view of the baffle of FIG. 3 removed from the scroll housing for purposes of clarity of illustration.

A baffle, indicated generally at 90 and illustrated best in FIG. 4, is mounted on the interior surface 38 upstream from the cutoff 36. From the orientation of the curved wall 22 illustrated in FIG. 3, the baffle 90 is preferably positioned in the circumference between lines A and B as indicated at arc 88. In other preferred embodiments, the baffle 90 is preferably positioned on the interior surface 38 in the approximate range of 0 and 90 degrees upstream from the intersection of the spiral portion 18 and the outlet portion 20, and most preferably positioned on the interior surface 38 in the approximate range of 0 to 45 degrees upstream from the cutoff 36.

The baffle 90 includes a mounting flange 92 and an interfering plate 94. The mounting flange 92 is secured to the interior surface 38 by any suitable means, e.g. spot welding, adhesive, etc. In other embodiments, the mounting flange 92 can be secured by a fastener, or the mounting flange 92 can be integrally molded with the scroll housing 12.

The interfering plate 94 projects into the annular volume of the spiral portion 18, preferably substantially perpendicular to the mounting flange 92. For purposes of illustration, the interfering plate 94 is shown as a planar member. Other shapes, including a concave member, can be utilized if desired. As the blower fan 56 rotates, the interfering plate 94 projects downwardly toward the blower fan 56 and interacts with the airflow instability 86 from the blades 58, thereby reducing the airflow noise. Preferably, the width W of the interfering plate 94 can range from as small as 12–14% of the width of the blower fan 56. This dimension will effectively diminish airflow noise without obstructing and reducing airflow in the scroll housing 12 to an unacceptable level. The height H and width W of the baffle 90 can be varied depending upon the airflow characteristics of a particular blower assembly.

The present invention provides a baffle 90 mounted on the interior surface 38 of a scroll housing 12 and positioned on the outlet side of the blower assembly 10 so as to interact with the exit flow of air from the blower fan 56. At the exit point from the blower fan 56, airflow instability 86 can occur which may cause undesirable airflow noise, particularly a low frequency oscillatory rumbling. The present baffle 90 described above diminishes the airflow noise without reducing airflow to an undesirable level. The present baffle 90 can also be incorporated in other applications having a rotating impeller, e.g., in axial flow compressors.

Although the present invention has been described with reference to a preferred embodiment, workers skilled in the art will recognize that changes may be made in form and detail without departing from the spirit and scope of the invention.

The embodiments of the invention in which an exclusive property or privilege is claimed are defined as follows:

1. A blower assembly comprising:

(a) a rotatable blower fan having a plurality of blades of a predetermined axial width for drawing axial airflow into the blower fan and expelling the airflow tangentially; and (b) a scroll housing rotatably mounting the blower fan, the scroll housing including (i) a spiral portion formed by a curved wall and an outer face to form an annular volume, wherein the blower fan is mounted on the outer face and draws an axial airflow into the annular volume;

(ii) an outlet portion joined with the spiral portion tangentially aligned with the blower fan for directing airflow exiting from the blower fan;

(iii) a cutoff formed at the intersection of a starting portion of the spiral portion and the outlet portion; and (iv) a baffle having a flange mounted on the interior surface of the spiral portion upstream of and up to approximately 90 degrees from the cutoff and an interfering plate aligned with the axial width of the blower fan blades in the annular volume between the interior surface of the spiral portion and an outer radius of the fan blades and projecting into the airflow exiting from the blower fan, whereby during operation of the blower fan, the baffle interacts with unstable airflow exiting from the blower fan blades and reduces airflow noise.

2. The blower assembly specified in claim 1 wherein the width of the interfering plate is in the range of 12 to 14% of the width of the blower fan blades.

3. The blower assembly specified in claim 1 wherein the interfering plate projects toward the axis of the blower fan.

4. The blower assembly specified in claim 1 wherein the spiral portion and the outlet portion are formed as an integrally molded construction.

5. The blower assembly specified in claim 4 wherein the cutoff is integrally molded with the spiral and outlet portions.

6. The blower assembly specified in claim 5 wherein the baffle is integrally molded with the cutoff and the spiral and outlet portions.

* * * * *